US008240280B2

(12) United States Patent
Busse et al.

(10) Patent No.: US 8,240,280 B2
(45) Date of Patent: Aug. 14, 2012

(54) DEVICE FOR CAMSHAFT ADJUSTMENT IN AN INTERNAL COMBUSTION ENGINE

(75) Inventors: Michael Busse, Herzogenaurach (DE); Michael Weiss, Reichertshofen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 392 days.

(21) Appl. No.: 12/529,961

(22) PCT Filed: Feb. 13, 2008

(86) PCT No.: PCT/EP2008/051737

§ 371 (c)(1), (2), (4) Date: Oct. 7, 2009

(87) PCT Pub. No.: WO2008/107275

PCT Pub. Date: Sep. 12, 2008

(65) Prior Publication Data

US 2010/0083924 A1 Apr. 8, 2010

(30) Foreign Application Priority Data

Mar. 8, 2007 (DE) ..... 10 2007 011 282

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS

| | | | | |
|---|---|---|---|---|
| 6,155,221 | A | 12/2000 | Ushida | |
| 6,302,072 | B1 * | 10/2001 | Sekiya et al. | 123/90.17 |
| 6,450,137 | B2 | 9/2002 | Ogawa | |
| 2001/0039932 | A1 | 11/2001 | Sekiya et al. | |
| 2003/0121485 | A1 | 7/2003 | Strauss | |
| 2006/0081204 | A1 | 4/2006 | Bilic et al. | |

FOREIGN PATENT DOCUMENTS

| | | | |
|---|---|---|---|
| DE | 102 18 201 | A | 10/2003 |
| JP | 2007-1 20 406 | E | 5/2007 |
| WO | 2005/108752 | Y | 11/2005 |
| WO | 2007/017130 | A | 2/2007 |

* cited by examiner

*Primary Examiner* — Ching Chang
(74) *Attorney, Agent, or Firm* — Lucas & Mercanti, LLP; Klaus P. Stoffel

(57) ABSTRACT

A device for camshaft adjustment in an internal combustion engine which has an inner rotor rotationally fixed to a camshaft. The inner rotor is rotationally adjustable relative to an outer rotor that is driveably connected to a crankshaft. At least one hydraulic chamber limited by side walls is introduced into the outer rotor and is divided into two partial chambers by an element extending radially outward from the inner rotor. To lock relative movement between the inner and outer rotor, two locking pins penetrating the inner rotor axially engage in two recesses of one of the side walls designed as a locking cover. To adjust the play of the locking pins in the recesses, at least one of the recesses has a stop surface for the locking pin, the position of which changes as viewed circumferentially with the radial distance from the axis of the inner rotor.

9 Claims, 4 Drawing Sheets

DEVICE FOR CAMSHAFT ADJUSTMENT IN AN INTERNAL COMBUSTION ENGINE

This application is a 371 of PCT/EP2008/051737 filed Feb. 13, 2008, which in turn claims the priority of DE 10 2007 011 282.5 filed Mar. 8, 2007, the priority of both applications is hereby claimed and both applications are incorporated by reference herein.

FIELD OF THE INVENTION

The invention relates to a device for camshaft adjustment in an internal combustion engine, which device has an inner rotor which is rotationally fixedly connected to a camshaft and which can be adjusted in rotation relative to an outer rotor which is drive-connected to a crankshaft, with at least one hydraulic chamber, which is delimited by side walls, being formed in the outer rotor, with said hydraulic chamber being divided into two sub-chambers by an element which extends radially outward from the inner rotor, and with two locking pins which extend axially through the inner rotor being provided for locking the relative movement between the inner rotor and outer rotor, which locking pins can engage into two recesses, which are formed into one of the side walls, which is designed as a locking cover.

BACKGROUND OF THE INVENTION

A camshaft adjusting device of said type is known from U.S. Pat. No. 6,450,137 B2. The device has an inner rotor which is screwed to the camshaft of the internal combustion engine by means of a central screw. The outer rotor is operatively connected to the crankshaft by means of a chain or a toothed belt. A relative rotary movement may be generated—controlled by means of an external hydraulic pressurization—between the inner rotor and the outer rotor. For this purpose, the inner rotor is embodied as a vane wheel which has grooves for holding vanes. The vanes separate a hydraulic chamber into two regions. An adjustment of the inner rotor relative to the outer rotor between an "early stop" and a "late stop" can be generated by means of corresponding pressurization of the respective section of the hydraulic chamber.

Thus, the camshaft adjuster has the function of varying the angular position of the camshaft with respect to the crankshaft of the internal combustion engine during operation. The angular position, which can be set with the described design, is stored in a characteristic map in an engine control unit and is defined substantially by the two parameters engine load and engine speed. During operation of the engine, the camshaft adjuster operates on the vane cell principle, that is to say the camshaft adjuster adjusts in the direction of the "early stop" or "late stop" by means of an oil pressure difference being generated in the hydraulic chambers.

During starting of the engine, there is the problem that there is insufficient oil pressure in the oil circuit of the engine in order to hold the camshaft adjuster in a certain position. As a result, the camshaft adjuster starts to oscillate in an uncontrolled manner. Furthermore, the striking of the vanes against the outer rotor (stator) generates noise.

It is known to solve the stated problem by providing axial locking between the inner rotor and a laterally arranged locking cover in the camshaft adjuster. Here, locking was usually provided in one of the end stop positions, "late" or "early". Here, it is relatively easily possible for the locking play to be set before the assembly of the camshaft adjuster by means of corresponding positioning of the inner rotor with respect to the outer rotor. On the one hand, said play must not be too large, since otherwise undesired noise is generated; on the other hand, said play also must not be too small, since otherwise the locking pin (locking piston) can no longer lock or unlock reliably.

The locking in the end positions "early" and "late" however also has disadvantages, and it is therefore sought to be able to provide locking in a central position between "early" and "late". "Center locking" differs from "end stop locking" in that the camshaft adjuster is locked in a defined angular position between the two end stops "early" and "late", which is advantageous in particular during the starting of the internal combustion engine.

The above-cited U.S. Pat. No. 6,450,137 B2 makes this possible by means of two locking pins (locking pistons) which extend axially through the inner rotor. The locking pins can engage with their one axial end into two recesses which are formed into one of the side walls, which is designed as a locking cover, of the camshaft adjuster. The two locking pins are arranged parallel to one another and are spaced apart from one another radially.

A disadvantage of said design is that, on account of the tolerance chain of the components, that is to say specifically of the locking pins in their bores and the recesses in the locking cover, locking play is generated which—in contrast to that locking play which occurs with end stop locking—cannot be set before assembly.

The locking play is determined substantially by the geometric spacing between the two bores in the inner rotor for holding the locking pins and the spacing between the two locking recesses (locking guide slots) in the locking cover. The spacing is therefore determined significantly by the production tolerances, with no manipulation being possible during assembly in previously known solutions. The play of the locking pins in their holding bores in the inner rotor, the radial bearing play of the inner rotor in the outer rotor, the centering of the locking cover on the outer rotor, and the dimensional accuracy of the locking guide slot are also influential. All of these effects make it particularly difficult to maintain a defined locking play in a camshaft adjuster of the generic type.

PROBLEM ADDRESSED BY THE INVENTION

The present invention is therefore based on the problem of refining a camshaft adjuster of the type specified in the introduction in such a way as to be able to obtain a substantially play-free arrangement even when using locking in the central position between "early" and "late", such that in particular the generation of noise remains low. Furthermore, the functioning of the locking and unlocking should be ensured by means of the selection of an optimum, small degree of play.

SUMMARY OF THE INVENTION

The solution to said problem by the invention is characterized in that at least one of the two recesses has a stop surface for the locking pin, the position of which stop surface as viewed in the circumferential direction varies with the radial distance from the axis of the inner rotor. It is preferable if the position of the two stop surfaces varies with the radial distance from the axis of the inner rotor.

One preferred refinement of the invention provides that at least one stop surface, preferably both stop surfaces, has/have a straight profile. Here, the stop surface may enclose an angle with the radial direction.

It may also be provided that the stop surfaces are arranged such that their spacing as viewed in the circumferential direction increases with increasing radial distance from the axis of the inner rotor. The reversed configuration is also possible, that is to say that the stop surfaces are arranged such that their spacing as viewed in the circumferential direction decreases with increasing radial distance from the axis of the inner rotor.

For simple assemblability with setting of the play between the stop surfaces and locking pins, it is highly advantageous if provision is made for that side wall of the device which is designed as a locking cover and the outer rotor to be designed such that the locking cover can be fixed in different radial relative positions with respect to the outer rotor. Here, it may be provided in particular that bores for the passage of fastening elements, in particular screws, are arranged in the locking cover or in the outer rotor, which bores permit a radial movement between the locking cover and the outer rotor.

Here, the locking cover is preferably of disk-shaped design.

The function of the locking cover is first to seal the oil chambers and secondly to transmit the drive torque from the crankshaft to the camshaft when the camshaft adjuster is axially locked.

With the proposed design of a camshaft adjuster, it is made possible to provide "center locking" in which, with the use of the two locking pins, a precisely adjustable play remains which maintains the functionality of the camshaft adjuster and which leads to expedient operating behavior, in particular as regards the generation of noise. The play for the locking pins can be set in a simple manner during the assembly of the camshaft adjuster.

In particular, it is not necessary to accept that an excessively large locking play is present in camshaft adjusters of the generic type, as is often the case in previously known solutions.

It is advantageously the case that no change to the axial installation space is required, that is to say the width or thickness of the cover is unchanged in relation to previously known solutions.

The proposed solution can also be used if an additional locking piston for additional end stop locking is situated in the camshaft adjuster, as is provided in some designs.

BRIEF DESCRIPTION OF THE FIGURES

The drawings illustrate exemplary embodiments of the invention. In the drawings.

DETAILED DESCRIPTION OF THE FIGURES

Figure 1:
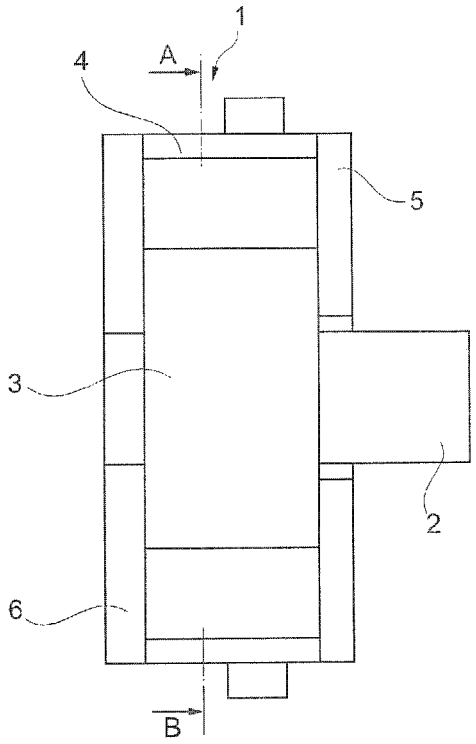
FIG. 1 schematically shows a side view of a camshaft adjuster which is connected to a camshaft.
Figure 2:
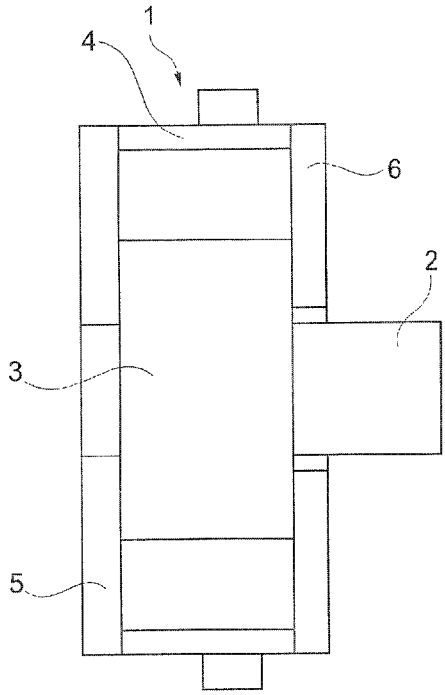
FIG. 2 shows an alternative design to the camshaft adjuster of FIG. 1.

FIG. 1 and FIG. 2 illustrate, merely in highly schematic form, a camshaft adjuster 1 by means of which a camshaft 2 can be adjusted in terms of rotational angle relative to the crankshaft. The figures depict an inner rotor 3 and an outer rotor 4 of the camshaft adjuster 1, with it being possible for the inner rotor 3 to be rotated relative to the outer rotor 4—as will be discussed in more detail below—in order to move the camshaft between an "early" working position and a "late" working position. The camshaft adjuster 1 has a first side wall 5 and a second side wall 6, with the second side wall 6 being designed as a locking cover which is required for axial locking, when the camshaft adjuster 1 is to be locked in a central position between "early" and "late", in particular for the starting of the engine.

A chain (not illustrated) serves to produce an operative connection between the crankshaft of the internal combustion engine and a drive gearwheel, which is rotationally fixedly connected to the outer rotor 4. An adjusting mechanism (not illustrated) produces a relative rotational adjustment between the outer rotor 4 and inner rotor 3. The inner rotor 3 is rotationally fixedly screwed to the camshaft 2 of the internal combustion engine by means of a central screw (not shown).

The two FIGS. 1 and 2 differ in that, in the case of the solution according to FIG. 1, the locking cover 6 is arranged on the side facing away from the camshaft 2. However, in the solution according to FIG. 2, the locking cover 6 is positioned on that side of the camshaft adjuster 1 which faces toward the camshaft 2.

The locking cover 6 of the camshaft adjuster 1 may thus be situated on the side facing toward or the side facing away from the engine. The axis of said locking cover 6 is aligned coaxially with the axis of the inner/outer rotor 3, 4 or of the camshaft 2, respectively.

Figure 3:
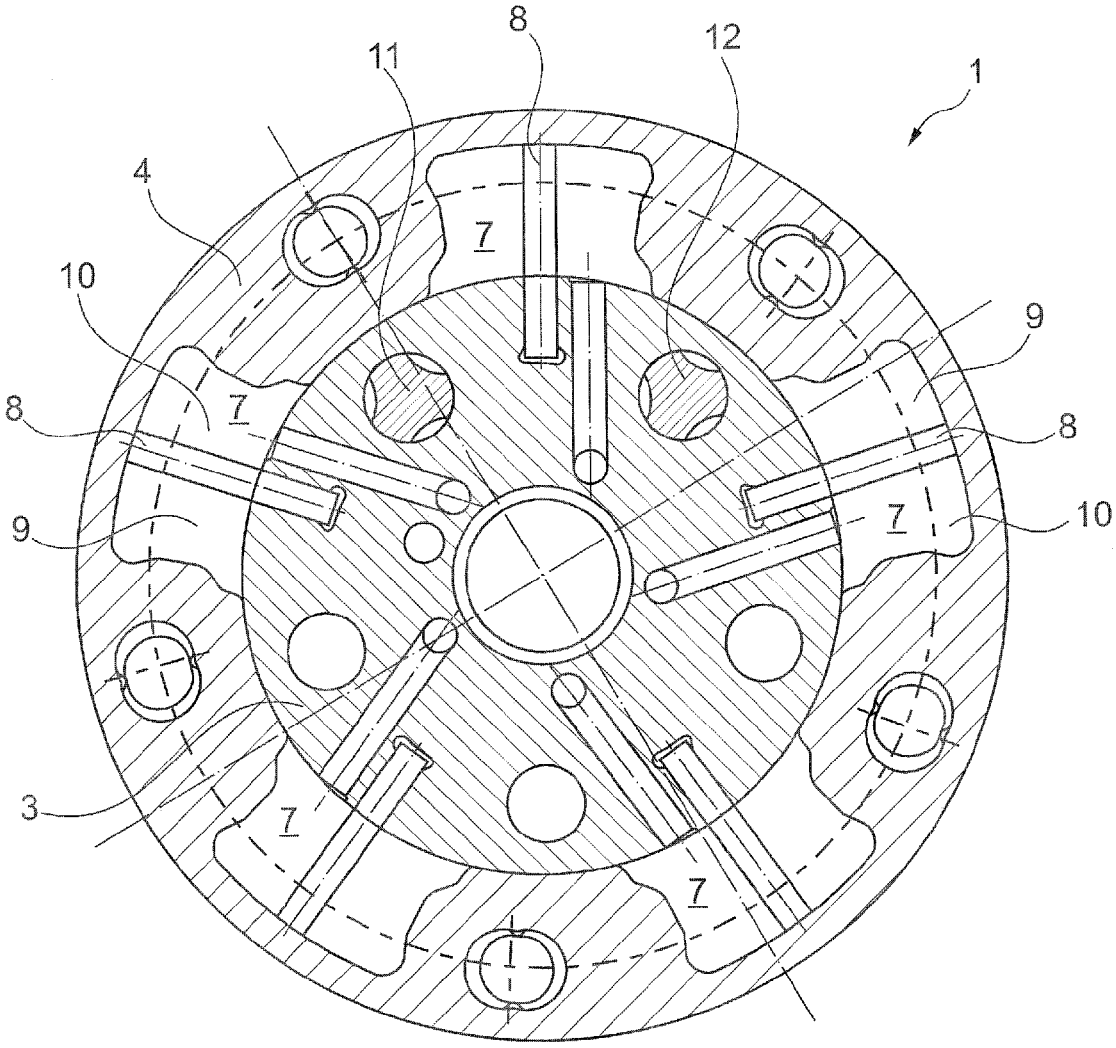
FIG. 3 shows the front view of the camshaft adjuster in section A-B according to FIG. 1, illustrated without auxiliary units.

FIG. 3 shows the design, which is known per se, of a generic camshaft adjuster 1. In the exemplary embodiment, the outer rotor 4 has five recesses formed therein, which recesses form hydraulic chambers 7. Said hydraulic chambers 7 are delimited by the two side walls 5, 6 (see FIGS. 1 and 2).

In the exemplary embodiment, five grooves are formed into the inner rotor 3, which grooves, in the present case, extend in the radial direction and along the axial direction of the camshaft adjuster. An element 8 in the form of a vane is inserted into each groove. The vane 8 extends, in its mounted state, radially up to the outer radial boundary of the hydraulic chamber 7. The hydraulic chamber 7 is thereby divided into two sub-chambers 9 and 10, which are connected (this is not shown in any more detail) in each case to hydraulic lines via which hydraulic fluid can be conducted into the sub-chambers 9, 10. The vane 8 may fundamentally also be designed as a sealing strip or similar element which can divide the hydraulic chamber 7 into two sub-chambers 9, 10.

The locking of the camshaft adjuster 1 in a central position between "early" and "late" is effected by means of two locking pins 11 and 12, which are inserted into corresponding bores in the inner rotor 3. The locking pins can be moved in the axial direction by means which are not illustrated, and act as locking pistons. In interaction with the design of the locking cover 6, it is possible for the relative rotation between the inner rotor 3 and outer rotor 4 to be blocked.

Figure 4:
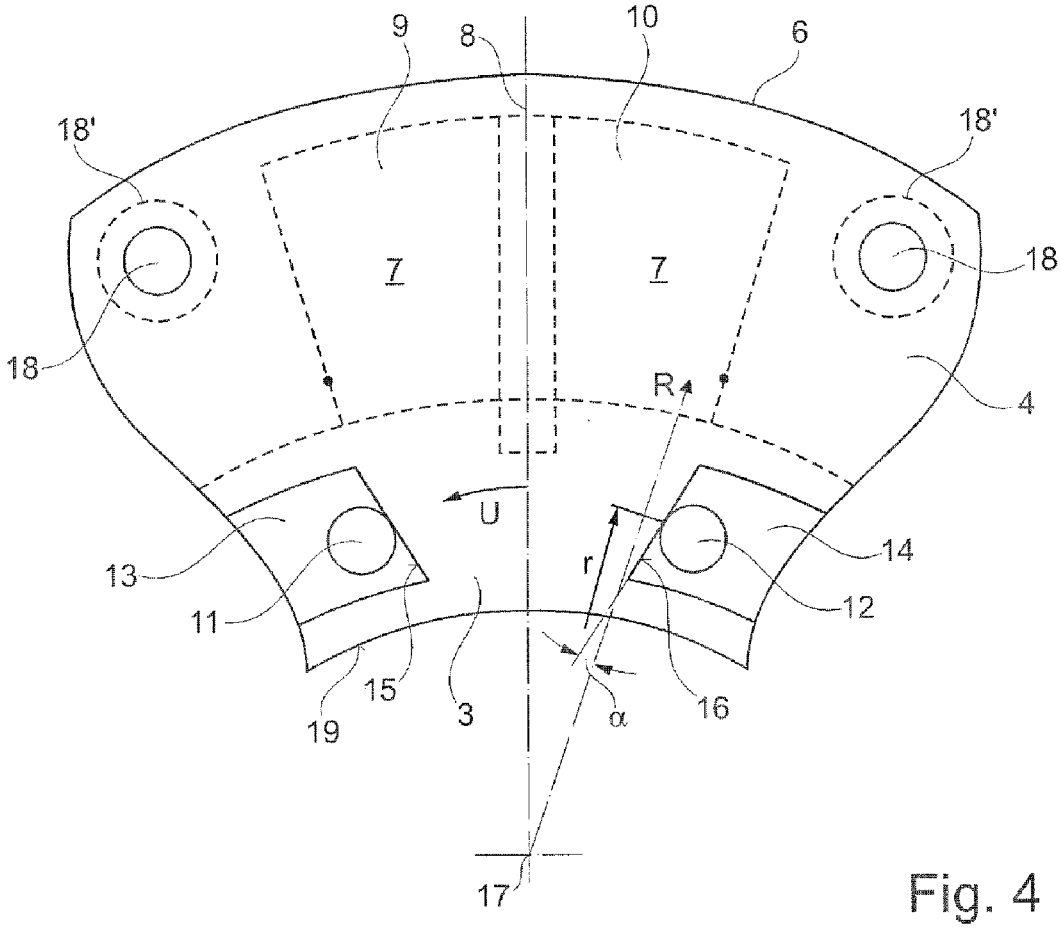
FIG. 4 shows the upper part of the front view according to FIG. 3 in an enlarged illustration, with the inner rotor, the outer rotor and the side wall which is designed as a locking cover being depicted.
Figure 5:
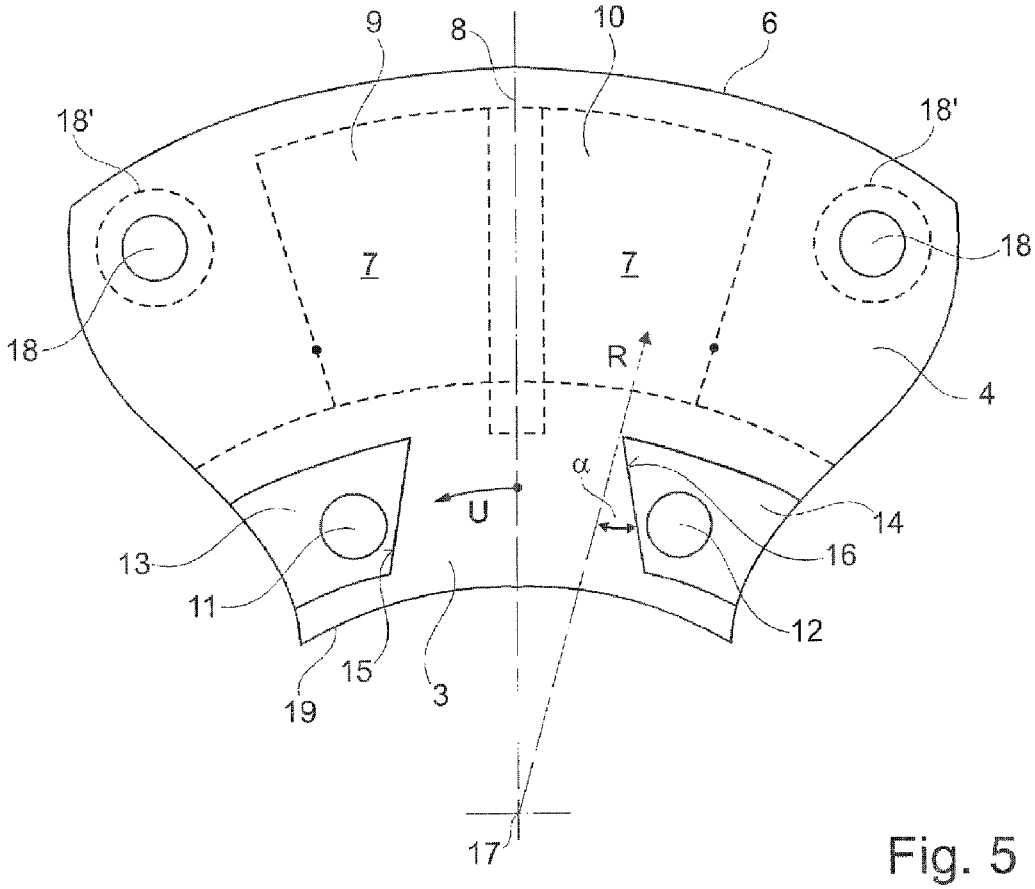
FIG. 5 shows an alternative embodiment to the invention of FIG. 4.

In this regard, reference is made to FIGS. 4 and 5 which show the locking cover 6 in interaction with the inner rotor 3 and the outer rotor 4.

Two recesses 13 and 14 are formed into the locking cover 6, which recesses 13 and 14 function as guide slots. Said recesses 13 and 14 serve to define stop surfaces 15 and 16 for the two locking pins 11 and 12, which stop surfaces 15 and 16 delimit the recesses 13, 14 in the circumferential direction U, such that when the locking pins 11, 12 are locked, the inner rotor 3 is fixed relative to the outer rotor 4, to which the locking cover 6 is fastened, in the circumferential direction U, specifically in a central position as shown in FIG. 4 (the vanes 8 are situated approximately centrally in the hydraulic chamber 7).

It is essential that at least one of the two recesses 13 and 14—in the exemplary embodiment both recesses 13, 14—has a stop surface 15, 16 for the locking pin 11, 12, in such a way that the position of said stop surface 15, 16—as viewed in the circumferential direction U—varies with the radial distance r from the axis 17 of the inner rotor 3. As can be seen, the two stop surfaces 15 and 16, which are of straight design here, are arranged at an angle α with respect to the radial direction R, which angle α is approximately 15° in this case.

The following advantageous effect is thereby obtained: when the locking cover 6 is moved relative to the outer rotor 4 in the radial direction R, a varying spacing between the two stop surfaces 15 and 16, as viewed in the circumferential direction U, is generated as a function of the radial relative position.

With regard to the exemplary embodiment in FIG. 4, this means that, in the event of a radial movement of the locking cover 6 relative to the outer rotor 4 in the outward direction with respect to the locking pins 11, 12, an increasing spacing is generated between the stop surfaces 15, 16, such that the play between the locking pins 11, 12 and the stop surfaces 15, 16 increases. Conversely, said play is reduced when the locking cover 6 is moved radially inward relative to the outer rotor 4.

In the embodiment according to FIG. 5, the two stop surfaces 15, 16 are in a reversed alignment. This means that, here, the play between the locking pins 11, 12 and stop surfaces 15, 16 decreases when the locking cover 6 is moved radially outward relative to the outer rotor 4. Correspondingly, said play becomes greater in the event of a movement of the locking cover 6 radially inward.

Said effect can be utilized to set the play between the locking pins 11, 12 and the stop surfaces 15, 16 in the locking cover 6 during the assembly of the camshaft adjuster.

A relative movement of the locking cover 6 relative to the outer rotor 4 is made possible in the exemplary embodiment according to FIGS. 4 and 5 by means of a design of the facility for fastening the locking cover 6 to the outer rotor 4, as depicted by the reference numerals 18 and 18'. Here, it can be seen that a bore 18 which is formed into the locking cover 6 for the passage of a fastening screw is aligned with a counterpart bore 18', which is designed as a through bore, in the outer rotor 4, which counterpart bore 18' is formed so as to be larger, thereby permitting a radial movement of the locking cover 6 relative to the outer rotor 4.

The locking cover 6 is designed as a thin-walled disk. A circular cutout 19 is provided in the center, which cutout 19 enables the camshaft adjuster to be mounted on the engine by means of a central screw. The outer diameter of the locking cover 6 corresponds to that of the outer rotor 4.

The number of bores 18 in the locking cover 6 is dependent on the number of hydraulic chambers 7 provided in the camshaft adjuster. The bores 18 may be embodied as through bores or as threaded bores.

In the event of an actuation of the locking pins 11, 12 (for example by means of the exertion of a spring force in the axial direction), said locking pins 11, 12 enter into the recesses 13, 14 and come to rest in the position illustrated in FIGS. 4 and 5. A drive torque can then be transmitted via said locking pins 11, 12 from the outer rotor 4 to the camshaft 2.

The two stop surfaces 15, 16 in the recesses 13, 14, which act as guide slots, thus act as a wedge by means of which the play can be set.

During assembly, during which the locking play for the locking pins is also set, the following procedure is followed:

During the setting of the locking play, the locking cover 6 is positioned in the required position with respect to the outer rotor 4, and is then fixed, similarly to the procedure with the previously known locking at an end stop.

During assembly, the camshaft adjuster is first fully pre-assembled in the locked state, but the screws for tightening the locking cover 6 are not yet tightened.

The outer rotor 4 (stator) is fixed in an assembly device. The inner rotor 3 is aligned in the outer rotor 4 with respect to the center locking position, and is likewise fixed.

The locking cover 6 is then moved in the radial direction R (inward or outward depending on the solution according to FIG. 4 or FIG. 5) until the play between the locking pins 11, 12 and the stop surfaces 15, 16 in the circumferential direction U is zero.

To set a desired locking play, the locking cover 6 is then moved back again (radially outward or inward) by a corresponding distance in the radial direction R, and is then fixed with screws.

LIST OF REFERENCE SYMBOLS

1 Device for camshaft adjustment
2 Camshaft
3 Inner rotor
4 Outer rotor
5 First side wall
6 Second side wall (locking cover)
7 Hydraulic chamber
8 Element (vane)
9 First sub-chamber
10 Second sub-chamber
11 Locking pin
12 Locking pin
13 Recess (guide slot)
14 Recess (guide slot)
15 Stop surface
16 Stop surface
17 Axis
18, 18' Bore
19 Cutout
U Circumferential direction
r Radial distance from the axis
R Radial direction
α Angle

The invention claimed is:

1. A device for camshaft adjustment in an internal combustion engine, comprising:

an inner rotor being rotationally fixedly connected to a camshaft and adjusted in rotation relative to an outer rotor which is drive-connected to a crankshaft;

at least one hydraulic chamber, which is delimited by side walls, being formed in the outer rotor, the hydraulic chamber being divided into two sub-chambers by an element extending radially outward from the inner rotor; and two locking pins extending axially through the inner rotor being provided for locking a relative movement between the inner rotor and outer rotor, the locking pins engaging into two recesses formed into one of the side walls which is designed as a locking cover, wherein at least one of the two recesses has a stop surface for at least one of the locking pins, the position of the stop surface as viewed in a circumferential direction varies with a radial distance from an axis of the inner rotor, wherein the one of the side walls of the device, which is designed as a locking cover, and the outer rotor are designed such that the locking cover is fixed in different radial relative positions with respect to the outer rotor.

2. The device of claim 1, wherein each stop surface position varies with the radial distance from the axis of the inner rotor.

3. The device of claim 1, wherein at least one stop surface has a straight profile.

4. The device of claim 3, wherein the stop surface encloses an angle with a radial direction.

5. The device of claim 3, wherein each stop surface is arranged such that a spacing of the stop surface, as viewed in the circumferential direction, increases with increasing the radial distance from the axis of the inner rotor.

6. The device of claim 3, wherein each slop surface is arranged such that a spacing of the stop surface, as viewed in the circumferential direction, decreases with increasing the radial distance from the axis of the inner rotor.

7. The device of claim 1, wherein bores for a passage of fastening elements are arranged in the locking cover or in the outer rotor, the bores permit a radial movement between the locking cover and the outer rotor.

8. The device of claim 7, wherein the fastening elements are screws.

9. The device of claim 1, wherein the locking cover is of disk-shaped design.

* * * * *